US006989048B2

(12) United States Patent
Bardon et al.

(10) Patent No.: US 6,989,048 B2
(45) Date of Patent: Jan. 24, 2006

(54) PARTICULATE FILTER FOR PURIFYING EXHAUST GASES OF INTERNAL COMBUSTION ENGINES COMPRISING HOT SPOT CERAMIC IGNITORS

(75) Inventors: Sébastien Bardon, Cheval Blanc (FR); Craig Willkens, Sterling, MA (US)

(73) Assignee: Saint-Gobain Centre de Recherches et d'Etudes Europeen, Courbevoie (FR)

( * ) Notice: Subject to any disclaimer, the term of this patent is extended or adjusted under 35 U.S.C. 154(b) by 44 days.

(21) Appl. No.: 10/415,409

(22) PCT Filed: Oct. 29, 2001

(86) PCT No.: PCT/FR01/03358

§ 371 (c)(1),
(2), (4) Date: Apr. 29, 2003

(87) PCT Pub. No.: WO02/36941

PCT Pub. Date: May 10, 2002

(65) Prior Publication Data

US 2004/0025500 A1 Feb. 12, 2004

(30) Foreign Application Priority Data

Oct. 31, 2000 (FR) ..... 00 13998

(51) Int. Cl.
*B01D 46/00* (2006.01)

(52) U.S. Cl. ..... 95/278; 95/14; 96/417; 96/420; 55/282.2; 55/282.3; 55/385.3; 55/482; 55/484; 55/523; 55/DIG. 10; 55/DIG. 30; 60/311

(58) Field of Classification Search ..... 95/1, 95/14, 17, 18, 278, 283; 96/417, 420; 55/282.2, 55/282.3, 395.3, 482, 484, 523, DIG. 10, 55/DIG. 30; 60/297, 303, 311
See application file for complete search history.

(56) References Cited

U.S. PATENT DOCUMENTS

| | | | | |
|---|---|---|---|---|
| 3,974,106 | A * | 8/1976 | Richerson | 252/516 |
| 4,319,896 | A | 3/1982 | Sweeney | |
| 4,427,418 | A | 1/1984 | Kogiso et al. | |
| 4,502,278 | A * | 3/1985 | Stark | 55/DIG. 10 |
| 4,505,107 | A * | 3/1985 | Yamaguchi et al. | 60/303 |
| 4,516,993 | A * | 5/1985 | Takeuchi et al. | 55/DIG. 10 |
| 4,535,589 | A * | 8/1985 | Yoshida et al. | 55/DIG. 10 |
| 4,548,625 | A * | 10/1985 | Ishida et al. | 55/282 |
| 4,652,727 | A * | 3/1987 | Hoshizaki et al. | 219/541 |
| 4,671,058 | A * | 6/1987 | Yoshida et al. | 55/DIG. 30 |
| 5,171,335 | A * | 12/1992 | Kojima et al. | 55/523 |
| 5,191,508 | A * | 3/1993 | Axelson et al. | 361/257 |
| 6,379,407 | B1 * | 4/2002 | Blackwell et al. | 55/282.3 |
| 6,461,398 | B2 * | 10/2002 | Peters et al. | 55/523 |
| 6,474,492 | B1 * | 11/2002 | Willkens et al. | 215/270 |

FOREIGN PATENT DOCUMENTS

| | | |
|---|---|---|
| FR | 2 771 449 | 5/1999 |
| RU | 2 059 841 | 5/1996 |

* cited by examiner

*Primary Examiner*—Duane Smith
*Assistant Examiner*—Jason M. Greene
(74) *Attorney, Agent, or Firm*—Young & Thompson

(57) ABSTRACT

A particulate filter for purifying exhaust gases of an internal combustion engine, in particular of a diesel engine, comprises a filtering body and heating elements for initiating combustion of soot particles accumulated on and in the filtering body. The heating elements comprise at least a hot spot ceramic ignitor (3). The invention is applicable in the automotive industry.

10 Claims, 2 Drawing Sheets

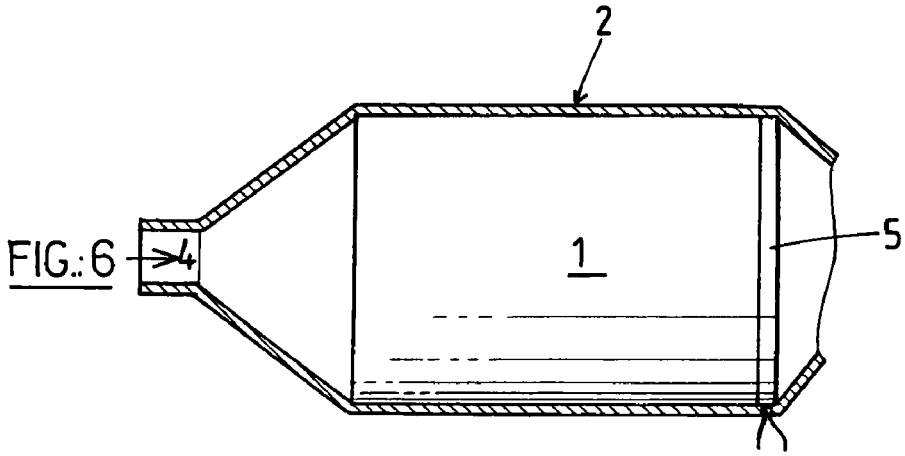
FIG. 7
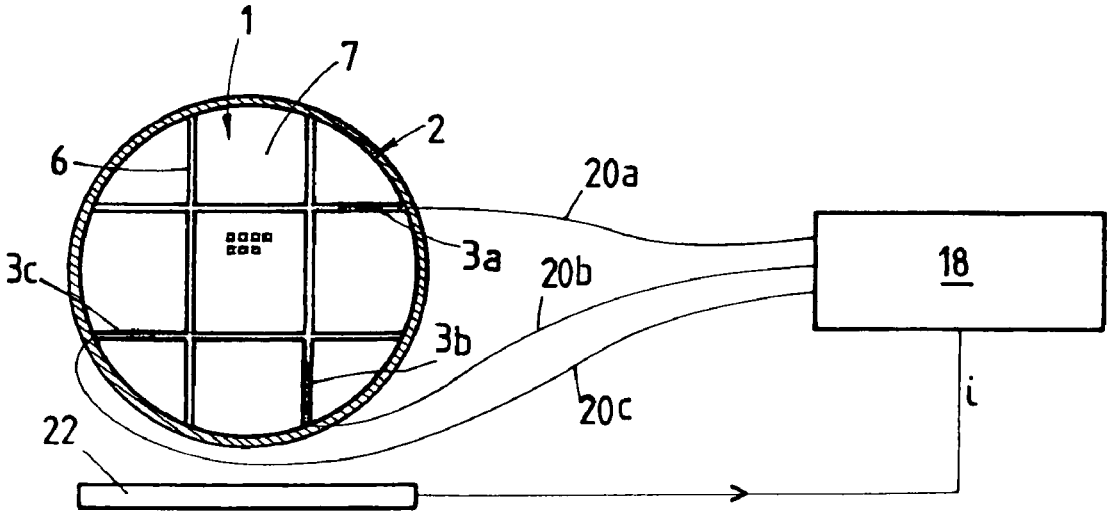

PARTICULATE FILTER FOR PURIFYING EXHAUST GASES OF INTERNAL COMBUSTION ENGINES COMPRISING HOT SPOT CERAMIC IGNITORS

CROSS REFERENCE TO RELATED APPLICATIONS

This is the 35 USC 371 National Stage of International Application PCT/FR01/03358 filed on 29 Oct. 2001, which designated the United States of America.

FIELD OF THE INVENTION

The invention relates to the use of ceramic ignitors to regenerate particulate filters for purifying exhaust gases of internal combustion engines, in particular diesel engines fitted to automobile vehicles.

BACKGROUND OF THE INVENTION

Honeycomb porous structures are used as filter bodies for filtering particles emitted by diesel vehicles. The filter bodies are usually made of ceramic (cordierite, silicon carbide, etc.). They can be monolithic or assembled from a plurality of blocks. In the latter case, the blocks are bonded together with a ceramic cement. The assembly is then machined to the required section, which is usually round or oval. The filter body can include a plurality of passages which are closed at one end or the other, can have different shapes and diameters in cross section, and is inserted into a metal casing, for example as described in FR-A-2 789 327.

After some time in use, soot accumulates in the filter body passages, in particular on the upstream face, which increases the head loss due to the filter body and therefore reduces the performance of the engine. For this reason the filter body must be regularly regenerated (for example every 500 kilometers).

Regeneration consists of oxidizing the soot. This requires heating, because the self-ignition temperature of the soot is of the order of 600° C. under the usual operating conditions, while the temperature of the exhaust gases is only of the order of 300° C. However, additives can be added to the fuel to catalyze the soot oxidation reaction and reduce the self-ignition temperature by approximately 150° C. The exhaust gases, the filter body or the soot can be heated. Various techniques have been developed but consume a great deal of energy and are very often difficult to control.

A recent and advantageous approach consists of localized heating ahead of the filter body to initiate combustion, which then propagates progressively to the whole of the filter body. This type of technique is described in FR-A-2 771 449 and DE-A 19530749, for example.

The means for heating particles deposited on the filter body are connected to an electrical power supply of the vehicle and consist of diesel engine preheater glow plugs, for example.

Such heating means have a number of drawbacks. First of all, they are bulky, which makes it difficult to position them relative to the filter body. FIG. 2 of FR-A-2 771 449 shows clearly that it is not possible to place the heating means in direct contact with the soot and even less so with the core of the filter body. Moreover, it is found that the presence of the heating means blocks access of the exhaust gases to a number of filter body passages, considerably reducing efficiency. Also, a great deal of energy is consumed and the regeneration system has a mediocre response time because the temperature increases relatively slowly.

Other heating means, such as simple electrical elements, are unsuitable because the temperatures can reach more than 1000° C. in the filter during combustion of the soot, and few materials can be used under these temperature and oxidation conditions because the problem of rapid wear due to corrosion becomes very serious.

There is therefore a need for heating means for particulate filters for purifying exhaust gases of internal combustion engines, in particular diesel engines, free of the drawbacks previously cited.

The invention aims to meet that need.

SUMMARY OF THE INVENTION

To be more specific, the invention provides a particulate filter for purifying exhaust gases of an internal combustion engine, in particular of a diesel engine, comprising a filter body and heating means for heating said filter body, characterized in that said means comprise at least one hot spot ceramic ignitor.

Hot spot ceramic ignitors are available off the shelf and are small, and when an electrical current passes through them they are locally heated to a very high temperature (1200° C. to 1400° C.), at which they can ignite gases. These devices are used in some domestic appliances, for example in gas cookers to ignite the burners. Hot spot ceramic ignitors are usually made from a highly resistive ceramic material such as silicon carbide, sometimes mixed with other ceramics.

The relationship between the electrical resistance of these devices and their geometry is well known in the art; ceramic ignitors can be produced in many and diverse shapes, making them easy to use. For example, the NORTON MINI-IGNITER® range of ignitors have a width of a few millimeters and a length that can vary from 2 to 4 centimeters.

Detailed information regarding the structure and fabrication of ceramic ignitors can be found in NORTON's U.S. Pat. Nos. 5,191,508, 5,085,804, 5,045,237, 4,429,003 and 3,974,106.

Hot spot ceramic ignitors have many advantages.

First of all, they are compact, which allows new and more advantageous positions in the filter. Located closer to the soot, these heating means transmit heat with minimum losses.

Also, hot spot ceramic ignitors consume little energy since they have a small surface area to be heated and use totally suitable ceramic materials. They can therefore be supplied with power by the power supply system(s) of the vehicle on which the filter is installed.

Hot spot ceramic ignitors most importantly yield a system with a very short response time. Although glow plugs take from 10 to 40 seconds to reach a temperature of 1000° C., ceramic ignitors can reach the same temperature in only 3 to 6 seconds. This is crucial because if heating is not sufficiently fast the soot tends to be consumed rather than ignited; this produces a kind of barrier that prevents propagation of combustion. What is more, regeneration of the filter is commanded and usually initiated only under optimum engine operating conditions. The effectiveness of regeneration is highly dependent on engine operating conditions. A very short response time very considerably reduces the risk of a significant change in engine operating conditions between starting the regeneration process and the moment which the soot is actually ignited.

Tests have shown that the low power consumption of each ignitor means that several ignitors can be used simultaneously. The number of ignitors can be higher or lower depending on their characteristics and the type of filter in which they are used.

The small size of the ignitors means that they can be positioned very accurately. This can be of particular advantage in achieving good coverage of areas where it is known that regeneration is poor in conventional systems, usually at the periphery of the filter body. The compact size of these heat sources also means that they can be positioned as close as possible to the filter body; there can even be point contact between the hot spot of the ignitor and either the filter body or the soot deposited on its surface.

Said filter body advantageously includes a plurality of filter blocks assembled together in at least one bonding area, also known as an "assembly joint", at least one of said ignitors being disposed within the thickness of said area.

The invention further provides a method of attenuating thermo-mechanical stresses in a particulate filter, remarkable in that relatively cold areas of said filter are selectively heated to reduce the temperature gradients that cause said stresses.

The invention finally provides a device for implementing the method according to the invention of attenuating thermo-mechanical stresses in a particulate filter, remarkable in that it includes ignitors adapted to heat at least one of said areas, a computer for controlling said ignitors, and means for evaluating said stresses adapted to supply information to said computer, said computer being programmed to control the selective ignition of said ignitors when said stresses exceed a particular threshold.

BRIEF DESCRIPTION OF THE DRAWING

The advantages of the invention will be better understood and appreciated after reading the following description with reference to the accompanying drawings.

In the drawings:

FIG. 6 is a diagrammatic view in longitudinal axial section showing an additional embodiment in which hot spot ignitors are disposed downstream of the filter body.

FIG. 7 shows diagrammatically a device for implementing a method in accordance with the invention of attenuating thermo-mechanical stresses, showing a filter thereof in cross section.

DETAILED DESCRIPTION OF THE INVENTION

Figure 1A:
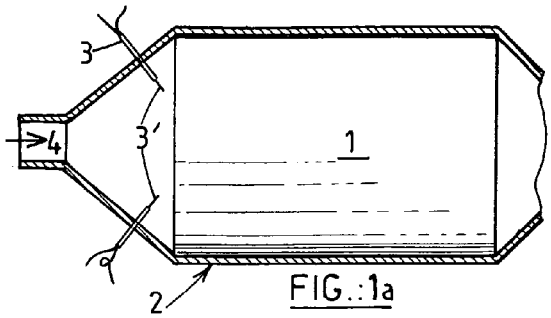
FIGS. 1*a* and 1*b* are diagrammatic views in longitudinal section showing two embodiments of a filter in accordance with the invention in which hot spot ceramic ignitors are fixed through and upstream of a metal casing surrounding a filter body.
Figure 1B:
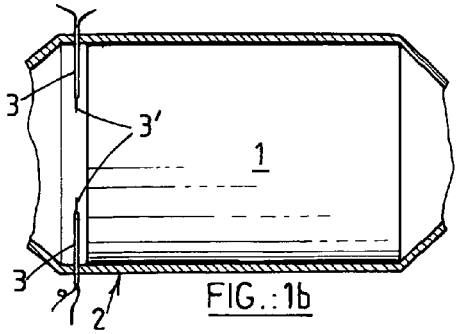

FIGS. 1*a* and 1*b* show a filter comprising a filter body 1 accommodated in a metal casing 2. The filter body 1 is constructed of blocks bonded together and pierced by many passages, as shown more clearly in FIG. 2*b.* Exhaust gases arrive via an inlet 4. In the two embodiments shown, four hot spot ceramic ignitors 3 (of which only two can be seen in FIGS. 1*a* and 1*b*) pass through the metal casing 2. They are positioned in pairs in orthogonal planes and either obliquely to the longitudinal axis of the filter (FIG. 1*a*) or perpendicularly to that axis (FIG. 1*b*), so that the hot spot 3' of each ignitor is in the immediate vicinity of the upstream face of the filter body. Thus the heat emitted and the radiation ignite the soot and initiate its combustion by propagating into all of the filter body.

Figure 2A:
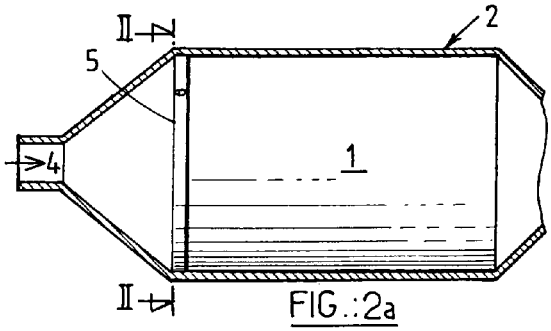
FIGS. 2*a* and 2*b* are respectively diagrammatic views in longitudinal axial section and in cross section taken along the line II—II in FIG. 2*a,* showing another embodiment in which hot spot ceramic ignitors are fixed to a ring in contact with a front face of the filter body.
Figure 2B:
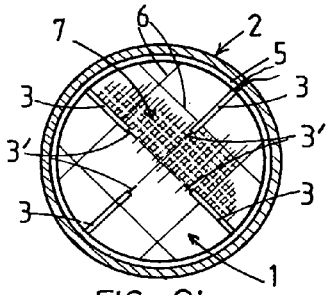

FIGS. 2*a* and 2*b* show an embodiment in which ignitors are carried by a ring 5 disposed in the metal casing 2 immediately in front of the filter body 1. To position the ring very accurately relative to the filter body, it can be bonded with a ceramic cement of the same type used to bond together the blocks pierced with passages and constituting the filter body. The ring 5 can be made of the same material as the filter body and have the same section. In this example, the section is circular, as shown clearly in FIG. 2*b.* Four ceramic ignitors 3 are equi-angularly spaced on the internal perimeter of the ring 5, for example, as shown clearly in FIG. 2*b.* This figure shows in the background (and in dashed outline) the bonding areas 6 between the blocks 7 pierced with passages and constituting the filter body. To simplify the diagram, the passages are shown in only one single block, their number has been reduced, and their section and the distances between the walls of two consecutive passages have been increased. The ring 5 is oriented so that the ignitors 3 coincide with the bonding areas.

This embodiment has several advantages over those of FIGS. 1*a* and 1*b.*

It avoids the ignitors passing through the metal casing, which is important on the automated assembly lines used in the automobile industry.

There is intimate contact between the hot spot of the ignitors and either the filter body or the soot accumulated on the filter body, and heat is transmitted from one to the other by conduction, rather than only by radiation. The rapid rise in temperature of the ignitors and the intimate contact referred to above considerably improve the response time of the system compared to the prior art devices.

Furthermore, this embodiment has the additional advantage of not affecting the operation of the filter in any way. Because the ignitors are lined up with the bonding areas 6, they do not obstruct the passages.

This embodiment relates to a filter whose filter body is constructed by assembling square section blocks, but the principle of mounting the ignitors on a support separate from the filter body and contiguous therewith could be applied to other filter body designs.

Figure 3A:
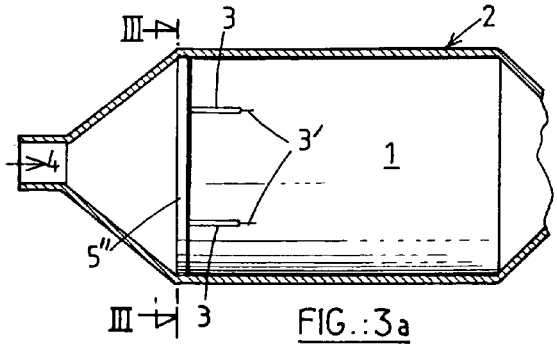
FIGS. 3*a* and 3*b* are respectively diagrammatic views in longitudinal axial section and in cross section taken along the line III—III in FIG. 3*a,* showing a further embodiment in which hot spot ceramic ignitors are disposed in passages in the filter body.
Figure 3B:
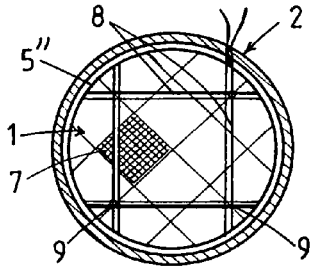

FIGS. 3*a* and 3*b* show an embodiment in which a ring 5' is inserted into the metal casing 2 in front of the filter body 1. Here the ring circumscribes a support grid 8 made of the same material as the ring and in one piece with it. Four ceramic ignitors 3 oriented perpendicularly to the grid and inserted into passages of the filter body are fixed at the intersections 9 of the grid. As before, a few passage sections 7 are shown in the background.

Obviously, it is the small size of the ignitors that allows this kind of positioning.

This embodiment is described with reference to a filter whose filter body is produced by assembling square section blocks, but the principle of positioning the ignitors in the passages of the filter body could obviously be applied to other filter body designs.

Figure 4:
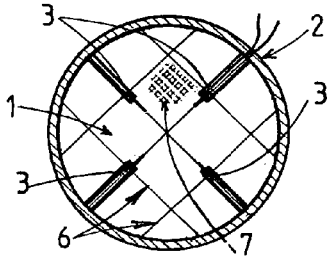
FIG. 4 is a diagrammatic view in cross section showing another embodiment in which hot spot ceramic ignitors are placed in contact with an upstream face of the filter body.

FIG. 4 shows the upstream face of a filter body 1 housed in a metal casing 2. The filter body is constructed from blocks bonded together in bonding areas 6. The figure has been simplified in the same way as FIGS. 2*b* and 3*b*. In this embodiment, the upstream face of the filter body has been machined in the bonding areas 6 to form depressions into which the ceramic ignitors 3 are inserted. The ignitors can optionally be bonded to the face of the filter body.

In a variant of this embodiment, to simplify implementation, the ignitors could simply be bonded to the upstream face of the filter body, without machining it.

These embodiments have the advantage that there is nothing passing through the metal casing and there is no need to add an additional component such as a ring. Furthermore, the flow of the exhaust gases is not affected, since the ignitors do not obstruct any of the passages.

This embodiment is described with reference to a filter whose filter body is produced by assembling square section blocks, but the principle of fixing the ignitors directly to the filter body or into depressions formed on the surface of the filter could be applied to other filter body designs.

Figure 5:
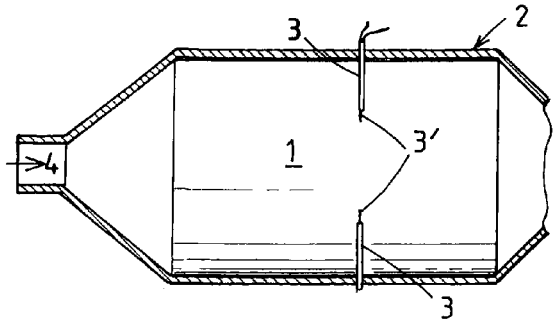
FIG. 5 is a diagrammatic view in longitudinal axial section showing a further embodiment in which hot spot ceramic ignitors are positioned in the filter body, through the metal casing.

FIG. 5 shows an embodiment in which the casing and the filter body are pierced to form bores therein into which the ceramic ignitors 3 are inserted. This embodiment avoids heating of the gas flow and all of the heat energy is transmitted to the soot.

Surprisingly, ceramic ignitors work under these particular operating conditions. They are usually employed to ignite a gas surrounding them whereas, in this new application, they are usually in contact with solid particles to be ignited, or in contact with the ceramic filter either directly or through the intermediary of a cement. This contact modifies the operation of the ignitors: for equivalent supplied energy, the operating temperature will be lower. In this application it will be of the order of 1000° C., whereas ignitors used conventionally are heated to temperatures of the order of 1200° C. to 1400° C. However, if required, the input of energy could be increased and higher temperatures achieved. These temperatures suggest that the heat is transmitted primarily by emission. Thus placing ignitors also on the downstream face of the filter, where there is a large amount of soot, can also be envisaged, as shown in FIG. 6, which shows the disposition against the downstream face of the filter 1 of a ring 5 carrying ignitors similar to that shown in FIGS. 2*a* and 2*b*. Replacing some of the plugs obstructing some of the passages on the downstream face of the filter body with ignitors could also be envisaged.

Normal operation of a particulate filter produces different heating of the different areas of the filter, especially during regeneration phases. During regeneration phases the areas of the filter body 1 in the vicinity of the downstream face are hotter than those in the vicinity of the upstream face because the exhaust gases carry in the downstream direction all of the heat energy released by combustion of the soot.

Furthermore, given the shape of the particulate filter and the resulting path of the exhaust gases, the soot does not necessarily accumulate in a homogeneous manner, for example accumulating more in the area of the filter body near its longitudinal axis. Combustion of the soot therefore causes a greater temperature rise in the core of the filter body 1 than in the peripheral areas.

The path of the hot exhaust gases and the cooling of the metal casing 2 by the surrounding air also lead, although to a lesser degree, to higher temperatures at the core of the filter body 1 in the absence of combustion of the soot.

The heterogeneous temperatures in the filter body 1 cause high thermo-mechanical stresses, which can cause cracks that reduce the service life of the particulate filter.

The filter according to the present invention has the advantage that it establishes and maintains a substantially homogeneous temperature in the filter body 1.

To this end, the device shown in FIG. 7 includes ignitors 3*a*, 3*b* and 3*c* connected to a computer 18 via respectively electrical wires 20*a*, 20*b* and 20*c*, and means 22 for evaluating the thermo-mechanical stresses in the filter body 1. The evaluation means 22 are adapted to supply information to the computer 18.

The evaluation means 22 can comprise means for measuring temperature gradients within the filter body 1, for example temperature sensors disposed in the filter body 1, and means for deducing the thermo-mechanical stresses therefrom. They can equally well comprise modeling means adapted to evaluate these gradients and/or the thermo-mechanical stresses, for example as a function of the time for which the vehicle has been on the road.

On receiving information "i" alerting it to the presence and the position of unacceptable localized thermo-mechanical stresses, for example if those stresses exceed a predetermined threshold, the computer 18 sends an ignition current to one or more of the ignitors 3*a*–3*c* to heat the relatively cold areas affected by the stresses. Heating reduces the temperature gradient and therefore the intensity of the thermomechanical stresses.

The hot spot ceramic ignitors 3*a*–3*c* can advantageously be inserted into the thickness of the bonding areas.

The embodiments referred to above are provided only to illustrate the invention and are in no way limiting on the invention. In particular, the ignitors could be positioned in and/or in the vicinity of the filter body in diverse other ways, exploiting the small size of the ceramic ignitors used by the invention. Moreover, for simplicity, only ignitors in the form of sticks have been shown, but ignitors could be used having different shapes and dimensions suited to their use for regenerating filters in accordance with the invention.

What is claimed is:

1. A particulate filter for purifying exhaust gases of an internal combustion engine, comprising a filter body and heating means for heating said filter body, wherein said heating means comprise a plurality of hot spot ceramic ignitors.

2. The filter according to claim 1, wherein the hot spot of at least one ignitor is in directed contact with the filter body or soot deposited on the filter body.

3. The filter according to claim 1, wherein the ignitors are disposed in the vicinity of the upstream face of the filter body.

4. The filter according to claim 1, wherein the ignitors are disposed in the vicinity of the downstream face of the filter body.

5. The filter according to claim 4, wherein the ignitors are disposed perpendicularly to passages in the filter body.

6. The filter according to claim 4, wherein the ignitors are disposed inside passages in the filter body.

7. The filter according to claim 1, wherein the hot spots of the ignitors are disposed inside the filter body.

8. The filter according to claim 1, wherein the filter body includes a plurality of filter blocks assembled together in at least one bonding area, at least one of said ignitors being disposed within the thickness of said bonding area.

9. A method of attenuating thermo-mechanical stresses in a particulate filter according to claim 1, comprising selectively heating relatively cold areas of said filter to reduce the temperature gradients that cause said stresses.

10. A device for implementing the method according to claim 9, which comprises ignitors adapted to heat at least one of said areas, a computer for controlling said ignitors, and means for evaluating said stresses adapted to supply information to said computer; said computer being programmed to control the selective ignition of said ignitors when said stresses exceed a particular threshold.

* * * * *